US005207769A

United States Patent [19]

Malta

[11] Patent Number: 5,207,769

[45] Date of Patent: May 4, 1993

[54] STRIKERLESS PERCUSSION MUSICAL INSTRUMENT

[75] Inventor: Jacob H. Malta, New Britain, Pa.

[73] Assignee: Malmark, Inc., Plumsteadville, Pa.

[21] Appl. No.: 785,805

[22] Filed: Oct. 31, 1991

[51] Int. Cl.[5] ..... A63H 5/00; G10D 13/08

[52] U.S. Cl. ..... 84/404; 84/402; 84/410; 84/DIG. 21; 446/418; 446/421; 446/422

[58] Field of Search ..... 84/402, 403, 404, 410, 84/DIG. 12; 446/418, 419, 421, 422

[56] References Cited

U.S. PATENT DOCUMENTS

| | | | |
|---|---|---|---|
| 479,636 | 7/1892 | Droop | 446/422 |
| 3,059,375 | 10/1962 | Tischer | 84/402 |
| 3,783,733 | 1/1974 | Zirimis | 84/402 |
| 4,463,517 | 8/1984 | Kerr et al. | 84/402 |
| 4,599,932 | 7/1986 | Malta | 84/404 |
| 4,658,694 | 4/1987 | Marks et al. | 84/402 |
| 4,846,753 | 7/1989 | Langston | 84/410 |
| 4,901,617 | 2/1990 | Malone et al. | 84/402 |

*Primary Examiner*—William M. Shoop, Jr.
*Assistant Examiner*—Helen Kim
*Attorney, Agent, or Firm*—Gregory J. Gore

[57] ABSTRACT

A hand-held percussion musical instrument includes a swinging tone-generating plate, which is hinged and moved when being played. The tone plate is sounded by impact with the body of the instrument, which includes a resonator and impact member located at the point of contact with the tone plate. The tone plate swings on a hinge, which is a flexible elastomeric joint that secures the tone plate to the resonator. A pleated, accordion-type elastomeric member is affixed between the end of the tone plate and body of the instrument to control the lateral movement of the tone plate and limit its back-swing.

9 Claims, 2 Drawing Sheets

STRIKERLESS PERCUSSION MUSICAL INSTRUMENT

FIELD OF THE INVENTION

This invention relates to handheld percussion musical instruments, including handbells and hand chimes.

BACKGROUND OF THE INVENTION AND PRIOR ART

Vibrating bar or tone plate devices of the xylophone and glockenspiel types are widely known and employ tone-generating plates or bars of metal or wood. The tone plates are accurately tuned by sizing to produce different musical notes. The tone plates are held in free suspension over an acoustically resonant sound chamber and are played by being struck with mallets or hammers.

Handheld percussion musical instruments, such as handbells and hand chimes, incorporate the sounding chamber, tone generator, and striking element into one, handheld unit. Swinging the instrument by hand causes the striking element to impact the tone generator to produce a musical note. A plurality of the handheld instruments are often played by an ensemble of players forming a musical choir.

A limitation with the musical instruments of the aforementioned type is that they are extremely expensive and delicate instruments. They therefore are inappropriate, or because of their cost, unavailable for introducing children to and educating them in the musical arts. There is, therefore, a need for an inexpensive and durable handheld instrument of musical quality. A percussion instrument is particularly suitable, since it requires only minimal dexterity possessed by children.

SUMMARY OF THE INVENTION

In order to fulfill the need in the musical arts as described above, the present percussion instrument has been devised. Its economy of manufacture and durability are provided by its unique, strikerless design, which reduces the number of operating parts by eliminating the striker. Thus, both cost and possibility of breakage are reduced. The invention described herein achieves the goals of simplicity and economy without sacrificing musical sound quality.

As will be more fully described herein by the following drawings and various embodiments of the present invention, a handheld instrument has been devised wherein the tone-generating plate is hinged and moves when being played, much like the traditional striker. The tone plate is sounded by impact with the body of the resonator, which includes an impact member located at the point of contact with the hinged tone plate. The resonator has an elongate, rectangular body with a handle at one end.

Novel hinge means also comprise an important part of the present invention. At one end of the tone plate, a flexible elastomeric joint is secured between the resonator and the tone plate which permits the tone plate to swing freely through a limited arc. At the opposite end of the tone plate, at one of its nodal points, a second elastomeric member of a unique pleated design controls the lateral movement of the tone plate and limits its backswing.

The instrument, therefore, has entirely eliminated the use of a separate striking element, and its swinging tone-generator is a metal bar-type which can easily be tuned by sizing to a desired frequency. Control of the motion of the tone plate is achieved by inexpensive, elastomeric elements which are attached to the tone plate at its nodal points. Thus, a handheld instrument of economical manufacture, yet musical tone quality, has been devised.

In an alternate embodiment, both the lateral movement of the tone plate and its backswing are controlled by a sliding pin which is affixed to the tone plate at its nodal point. The pin passes through a hole in the top of the resonator with minimal clearance so that lateral stability is provided. In this embodiment, the pin replaces the pleated accordion hinge of the preferred embodiment.

In yet another embodiment of the present invention, a U-shaped guard is added to the end of the resonator which can be used alone or in conjunction with the pleated hinge of the preferred embodiment. The guard has an arch which includes lateral sides that enclose the sides of the tone plate at all points throughout its arc of motion. The guard may also include a tone plate bumper along the inner surface of its arch in order to control the backswing of the tone plate.

In yet another embodiment, the impact element on the resonator is a circular, rotatable elastomeric member with a plurality of different size holes along its periphery. This impact element provides adjustability to the sharpness of the tone produced.

It is, therefore, an object of the present invention to provide an inexpensive handheld percussion musical instrument which produces a musical sound of a high quality. It is a further object of the present invention to produce a handheld percussion musical instrument which is suitable for use by young children, being both durable and inexpensive. Other objects and advantages of the present invention will be readily apparent to those skilled in the musical instrument arts from the following drawings and description of the preferred embodiment.

DESCRIPTION OF THE PREFERRED EMBODIMENT

Figure 1:
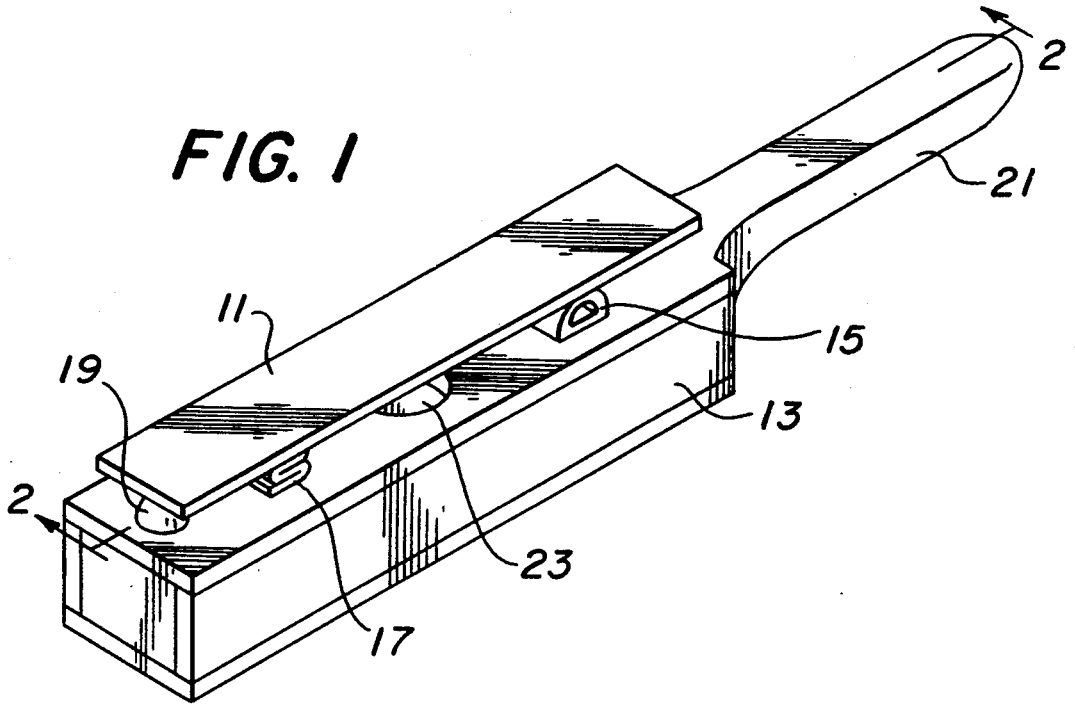
FIG. 1 is top, right front perspective view of the present invention.

Referring now to FIG. 1, tone plate 11 is secured to the body of the musical instrument 13 by a tubular, elastomeric connector 15 and accordion-type elastomeric hinge 17. The tone plate 11 swings relative to body 13 by elastic deformation of connector 15 to contact impact element 19 when manually swung by the operator using handle 21.

Figure 2:
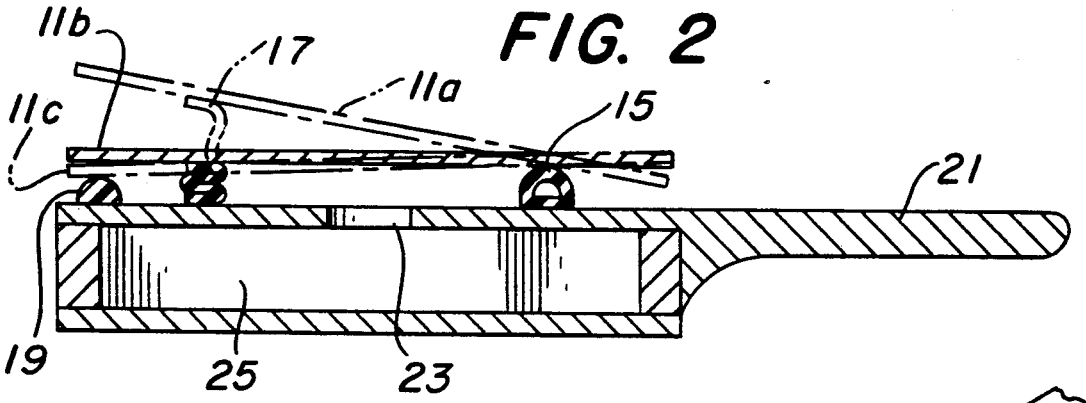
FIG. 2 is a side sectional view taken from FIG. 1 as shown in that figure and includes different positions of the tone plate shown in phantom lines.

Referring now to FIG. 2, various positions of the tone plate 11*a*, 11*b*, and 11*c* are shown. The body of the instrument is hollow and includes interior resonator space 25 that is open to the area around the tone generating plate through aperture 27. In operation, the instrument is swung by handle 21 upward, thereby throwing the tone plate into the fullest extent of its backswing shown by position 11*a*. Its backswing in this embodiment is restricted by the full extension of accordion hinge 17. The instrument is then moved sharply downward which causes the tone plate to move in that direction about the connector 15 to which it is affixed. The tone plate thereby moves into contact with impact member 19 which sets the tone plate into mechanical vibration, thus sounding the instrument. At its point of contact with the impact element, the accordion hinge is compressed beyond its free state. After sounding, the tone plate assumes its rest position shown by 11*b* and is held in free vibration at that position by the accordion hinge 17 and elastomeric connector 15, which are attached to the tone plate at its nodal points. In this sustained position, the tone plate is held away from the impact element. Hinge 17 is preferably an elastomeric rubber compound which is secured between the tone plate and the top of the instrument body by a suitable adhesive. Connector 15 is preferably tubular with a D-shaped cross section.

Figure 3:
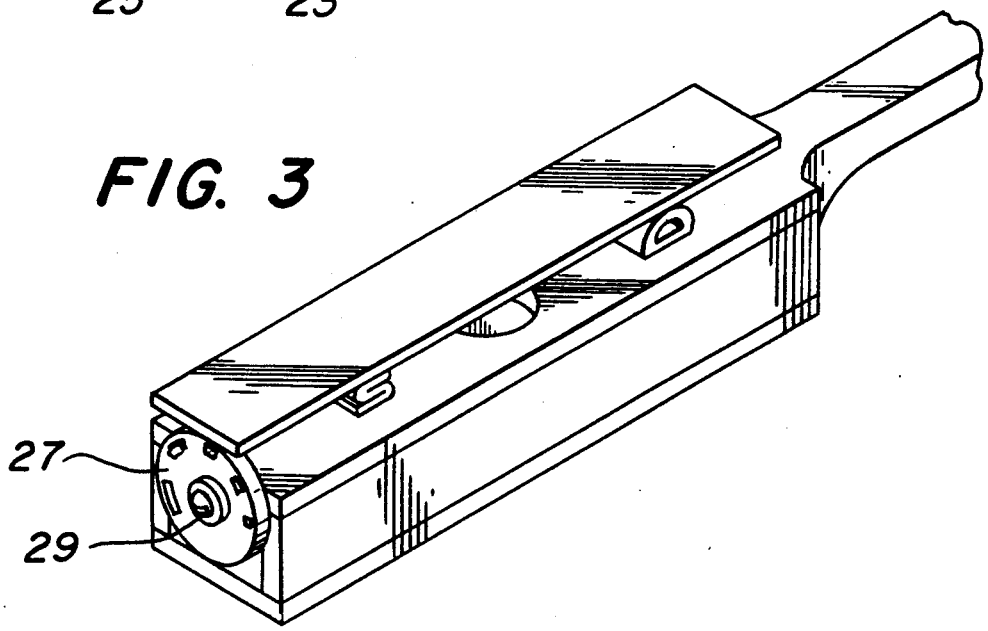
FIG. 3 is a top, right front perspective view of an alternate embodiment of the present invention, including an adjustable impact member.

FIG. 3 shows an alternate embodiment of the present invention shown in FIG. 2, wherein the impact member 19 has been replaced by a rotatable impact element 27 which is affixed to the end of the body of the instrument by fastener 29 located at the center of the impact element. The impact member 27 is disk-shaped and includes a series of apertures along its periphery. The apertures are of differing size, and rotation of this element to locate different apertures directly below the impact point with the tone plate allows the sharpness of the sound of the instrument to be adjusted.

Figure 4:
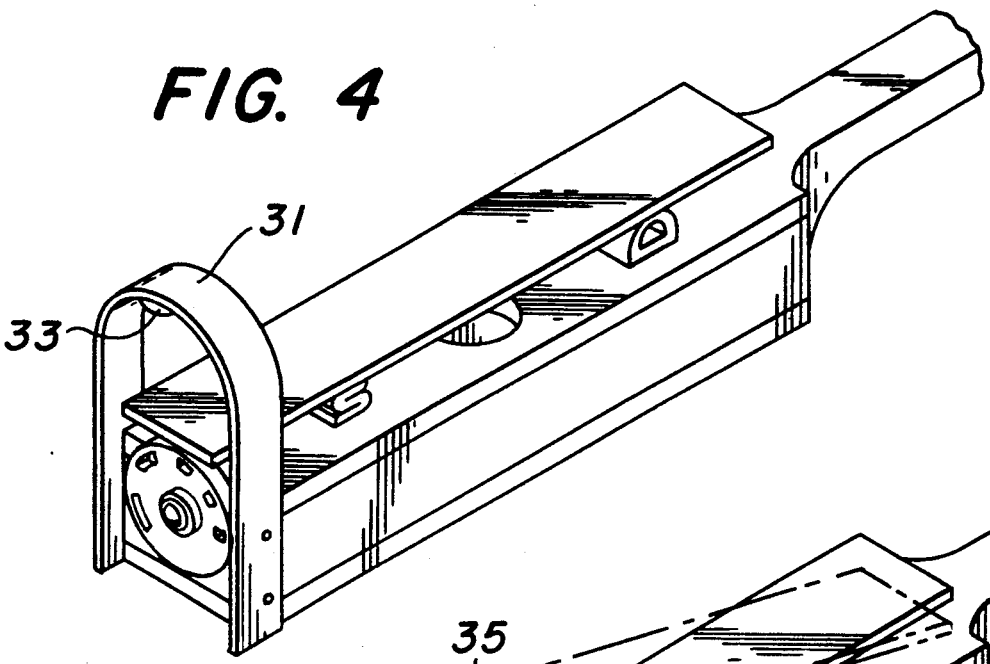
FIG. 4 is a top, right front perspective view of an alternate embodiment of the present invention showing the addition of a tone plate guard.

Referring now to FIG. 4, the embodiment in FIG. 3 has been supplemented by the addition of guard 31 attached to the end of the instrument body. The guard is U-shaped and attaches to the side of the body of the instrument extending a distance from the end of the instrument beyond all other structures. The guard protects the impact element and the tone plate from unwanted contact when the instrument is being handled. The guard is U-shaped and may further include a backswing bumper 33 located on the inner side of the topmost point of its arch. The backswing bumper contacts the end of the tone plate during its backswing, thereby eliminating the extent of its travel.

Figure 5:
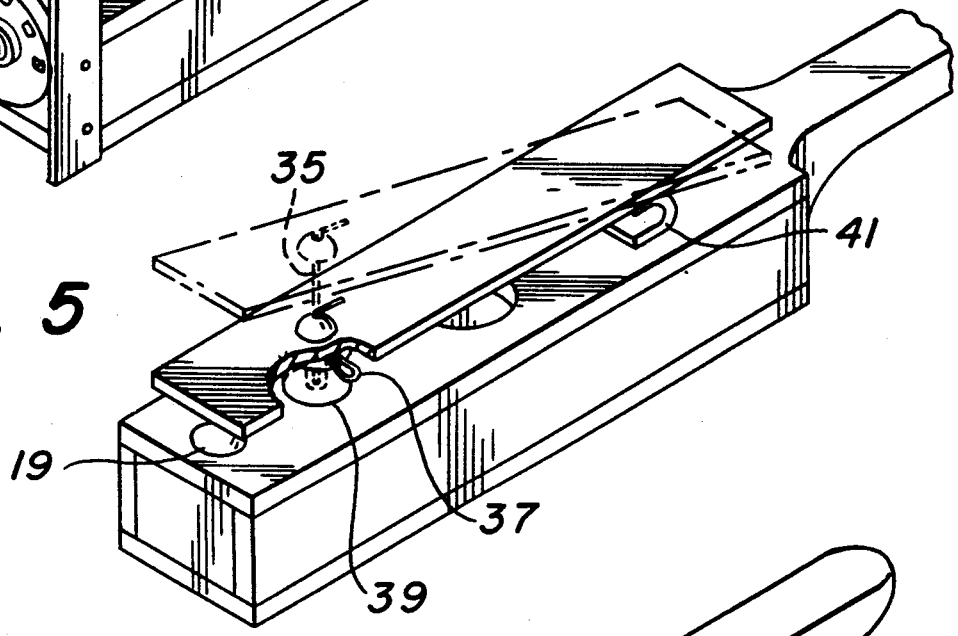
FIG. 5 is a top, right front perspective view of an alternate embodiment of the present invention showing the use of a resonator-mounted sliding pin to restrict movement of the tone plate.

FIG. 5 shows yet another embodiment of the present invention where the embodiment shown in FIG. 1 has been modified. The elastomeric accordion hinge has been replaced by a sliding pin 35 affixed through the nodal point at the end of the tone plate. Extension of the pin is limited by string 37. The tone plate is held a distance from the impact member 19 during its tonal sustain by compressible elastomeric collar 39. In this embodiment, the D-shaped elastomeric connector of FIG. 1 has been replaced with a U-shaped connector 41.

Figure 6:
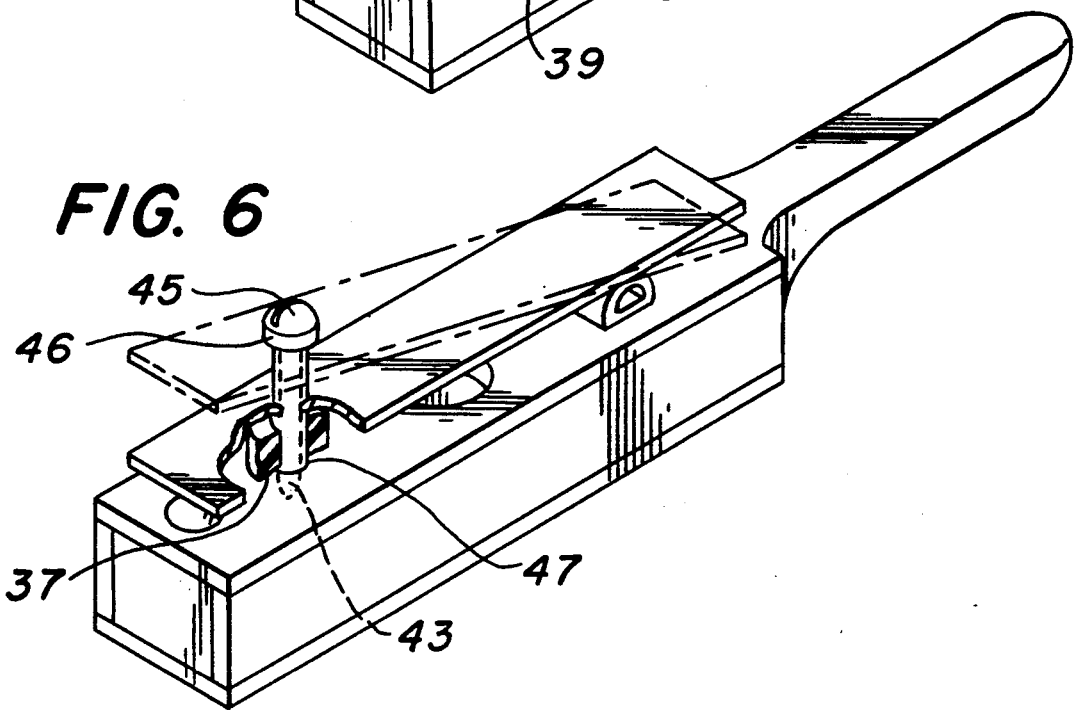
FIG. 6 is a top, right front perspective view of an alternate embodiment of the present invention showing a resonator with a fixed post for controlling the movement of the tone plate.

Referring now to FIG. 6, another embodiment of the present invention is shown. Like the embodiment shown in FIG. 4, all elements of the invention are similar to the embodiment shown in FIG. 1, but modified. In FIG. 6, the accordion hinge of FIG. 1 has been replaced by rigid post 43 which is secured to the top of the body of the instrument by fastening means 45. A collar 46 functions as a cushion between the tone plate and the head of fastening means 45. The post includes a sleeve 47. The post and collar extend through an aperture at the end of the tone plate located through its nodal point. In this figure, the tone plate backswing and sounding positions are shown and, similar to the embodiment shown in FIG. 5, an elastomeric collar 37 is used to hold the tone plate a distance from its impact element in its sustain position after it has been sounded.

It should be understood that the above description discloses specific embodiments of the present invention and are for purposes of illustration only. There may be other modifications and changes obvious to those of ordinary skill in the art which fall within the scope of the present invention which should be limited only by the following claims and their legal equivalents.

What is claimed is:

1. A handheld percussion musical instrument, comprising:

an elongate body, including a resonator at one end and a handle at the opposite end;

a swinging tone plate fastened to said body by a connector which suspends the plate directly above said resonator and permits the tone plate to move through a limited arc; and an impact element rigidly affixed to said body, said element located at the contact point of said body and said tone plate, such that when the instrument is played, the tone plate is swung into contact with said impact element, thus sounding the tone plate.

2. The handheld instrument of claim 1 wherein said connector is affixed to said tone plate at a first nodal point of said tone plate.

3. The handheld instrument of claim 2 further including an accordion-type hinge located at a second nodal point of said tone plate.

4. The handheld instrument of claim 2 further including a sliding pin received in an aperture in the top of said resonator, said pin affixed to said tone plate at a second nodal point such that as the tone plate moves through an arc of motion, said pin controls both the lateral movement of said tone plate and the extent of its backswing.

5. The handheld instrument of claim 2 further including a U-shaped guard affixed at the opposite end of said body, said guard having an arch which laterally surrounds the end of the tone plate throughout the tone plate's range of motion.

6. The handheld instrument of claim 5 further including a bumper affixed to the inside of said guard at the top of its arch on its inner surface, said bumper contacting said tone plate at the fullest extent of the tone plate's backswing.

7. The handheld instrument of claim 2 further described in that said impact element is circular and affixed to the opposite end of said body.

8. The handheld instrument of claim 7 wherein said impact element further includes a plurality of different size holes located around the periphery of the impact element, said element being rotatably affixed to the opposite end of said body, such that said impact element is adjusted to control the sharpness of the instrument sound by positioning different sizes of said holes beneath the contact point with said tone plate by rotating the impact element.

9. A handheld percussion musical instrument, comprising:

an elongate body, including a handle at one end;

a swinging member attached to the body by a hinge;

tone-producing means sounded by impact of the swinging member; and a U-shaped guard attached to the body which surrounds the swinging member laterally at all positions of said member, for protecting said swinging member and said tone-producing means from unwanted contact.

* * * * *